US009884417B2

(12) United States Patent
Li et al.

(10) Patent No.: US 9,884,417 B2
(45) Date of Patent: Feb. 6, 2018

(54) LIGHTWEIGHT MOP AND MOP BUCKET USED THEREWITH

(71) Applicant: Jun Li, Tianjin (CN)

(72) Inventors: Jun Li, Tianjin (CN); Nan Li, Tianjin (CN); Da Li, Tianjin (CN)

( * ) Notice: Subject to any disclaimer, the term of this patent is extended or adjusted under 35 U.S.C. 154(b) by 115 days.

(21) Appl. No.: 15/045,250

(22) Filed: Feb. 17, 2016

(65) Prior Publication Data

US 2016/0193728 A1 Jul. 7, 2016

Related U.S. Application Data

(63) Continuation of application No. PCT/CN2015/071085, filed on Jan. 20, 2015.

(30) Foreign Application Priority Data

Jan. 22, 2014 (CN) ..... 2014 1 0028151
Jan. 22, 2014 (CN) ..... 2014 2 0038398 U

(51) Int. Cl.

| | |
|---|---|
| ***B43M 11/02*** | (2006.01) |
| ***B25G 1/06*** | (2006.01) |
| ***A47L 13/254*** | (2006.01) |
| ***A47L 13/46*** | (2006.01) |
| ***A47L 13/60*** | (2006.01) |
| ***A47L 13/12*** | (2006.01) |
| ***A47L 13/22*** | (2006.01) |
| ***A47L 13/59*** | (2006.01) |
| ***B25G 3/38*** | (2006.01) |

(52) U.S. Cl.
CPC ..... *B25G 1/06* (2013.01); *A47L 13/12* (2013.01); *A47L 13/22* (2013.01); *A47L 13/254* (2013.01); *A47L 13/46* (2013.01); *A47L 13/59* (2013.01); *A47L 13/60* (2013.01); *B25G 3/38* (2013.01)

(58) Field of Classification Search
CPC ..... A47L 13/22; A47L 13/12; A47L 13/58; A47L 13/59; A47L 13/60; A47L 13/254; A47L 13/46
See application file for complete search history.

(56) References Cited

U.S. PATENT DOCUMENTS 9,307,882 B2 * 4/2016 Zhu ..... A47L 13/142
9,609,994 B2 * 4/2017 Young ..... A47L 13/60

* cited by examiner

*Primary Examiner* — Jennifer C Chiang
(74) *Attorney, Agent, or Firm* — Wayne & Ken, LLC; Tony Hom

(57) ABSTRACT

The present disclosure relates to a portable mop and a mop bucket used with the portably mop. The portable mop includes a mop rod (1). The mop rod (1) is provided with a steering mechanism (5). The steering mechanism (5) includes a sleeve nut (6), a locking thread sleeve (7) and a hinged ladder rotating shaft (8). A hinge plane (10) is arranged at the upper end of the hinged ladder rotating shaft (8). The mop bucket includes an integrated squeezing and brushing device is formed by the connection of the squeezing roller pair and the brush body by virtue of a combined support; the combined support comprises a left and a right side baffles; and the brush body is fixedly connected with the squeezing roller pair through connecting screw rods to form a whole.

10 Claims, 10 Drawing Sheets

LIGHTWEIGHT MOP AND MOP BUCKET USED THEREWITH

CROSS-REFERENCE TO RELATED APPLICATIONS

This application is a continuation of International Patent Application No. PCT/CN2015/071085 with an international filing date of Jan. 20, 2015, designating the United States, now pending, and further claims priority benefits to Chinese Patent Applications No. 201410028151.8, filed Jan. 22, 2014 and Chinese Patent Applications No. 201420038398.3, filed Jan. 22, 2014. The contents of all of the aforementioned applications, including any intervening amendments thereto, are herein incorporated by reference.

TECHNICAL FIELD

The present invention belongs to a cleaning tool, and particularly to a portable mop and a mop bucket used therewith.

BACKGROUND

A common flat mop is roughly divided into a single-sided cloth clamping type mop and a two-sided cloth type mop, and widely used due to the advantages of uniform and universal force of a wiping surface during operation of cleaning ground. But, the mop also has the defects of being heavy in use, troublesome in fabric clamping and cleaning, difficult to clean and the like. The applicant discloses a portable mop with a simple structure with the patent number: ZL201020154630.1, comprising a mop rod and a mop panel, wherein the mop panel is a polygonal mop panel made of elastic materials; an inserted connecting mechanism and a limiting device that enables the mop panel to rotate relative to the mop rod forward and backward in a limited angle are arranged between the upper end of the mop panel and the lower end of the mop rod; and the mop panel has a straight position and a bending position; in an off-working state, a central axis of the mop rod and a center line of a longitudinal section of the mop panel are in a straight line; in a working state, the mop panel is deformed under external force, the lower end of the mop panel is parallel to a working surface, and the upper end of the mop panel is an arc surface and has an angle with the mop rod. Clean fabrics are nested on the mop panel in a shape of a slash pocket on one side, and fixed by a thread gluing, a moving clip or an elastic cord. Meanwhile, the present invention further discloses a mop bucket used with the portable mop, and dirt on a mop cloth can be removed and the mop is dehydrated by virtue of the mop bucket through up-and-down motion or forward and backward motion. An inverted "U"-shaped clamping slot in an inserted connecting structure in the solution is in an overall fixed structure, and workpieces by taking plastics as a base material are easily expanded and shrunk due to seasonal change, which causes the upper end of a slot wall is fractured. Therefore, it is found that the life and the reliability of the workpieces have defects during use. A new structure of a portable mop with a simple structure is further disclosed, having patent number of ZL201020569481.5 and comprises a mop rod and a mop panel, wherein the mop panel is a polygonal mop panel made of elastic materials, and a flat connecting mechanism, a clamping connecting mechanism and an inserted connecting mechanism are arranged between the upper end of the mop panel and the lower end of the mop rod; the mop panel has a straight position and a bending position; in an off-working state, a central axis of the mop rod is parallel to a center line of a longitudinal section of the mop panel, and in a working state, the mop panel is deformed, the lower end of the mop panel is parallel to a working surface, and the upper end of the mop panel is an arc surface and has an angle with the mop rod. Meanwhile, at a technical level, a new improvement of laying an anti-tensile film and flexible fabrics on the mop panel and making a compound sandwich board with elastic plastics and a fiber sandwich is further made. The problem that a user can carry out the continuous operation of cleaning and dehydration without the need for dismantling the mop cloth by hands is solved by coordinating with a squeezing roller and a brush body arranged in the mop bucket. The disadvantages of the patented product found during the use are incapability of wiping turnings or hidden corners, or corners with small width; meanwhile, when the moisture of the mop cloth is insufficient during the operation, the moisture cannot be supplemented by virtue of the device of the mop, so the continuous operation is affected; other tools are used in case of hard dry rice and leaves stuck to the surface of tiles in a kitchen in a wiping process; and the cleaning problem of the panel mop is solved by virtue of a brush arranged in the mop bucket used with the portable mop, but the squeezing roller and the brush body are not reasonable in layout in the bucket and a baffle plate divided into a squeezing part and a cleaning part occupies a limited work space, thereby being adverse to operate, save water and clean the bucket, and also being adverse to produce, stack and transport. The above patented product is not suitable for being promoted as a commodity due to many disadvantages.

SUMMARY

The purpose of the present invention is to overcome the defects of the above technology, thereby providing a portable mop and a mop bucket used therewith for achieving the function of wiping the hidden corners by turning; mop heads with narrow and wide working surfaces can also be rapidly replaced; the squeezing rollers and the brush body can be rearranged; the working space of the mop bucket can be increased for the convenience of washing; and meanwhile, the functions of wiping while adding water and shoveling hard lumps can also be achieved.

To achieve the above purpose, the present invention adopts the following technical solutions: A portable mop comprises a mop rod, a mop panel and a baggy mop sheath. The upper end of an elastic flaky mop panel is connected with the mop rod through a clamping structure; the clamping structure is composed of a clamping body and a clamping plate. The portable mop is characterized in that a steering mechanism is arranged on the mop rod and comprises a sleeve nut, a locking thread sleeve and a hinged ladder rotating shaft, wherein the locking thread sleeve is provided with an external thread; the upper end of the locking thread sleeve is in a shape of a circular cone and is provided with a plurality of openings; the center of the locking thread sleeve is provided with a round hole; a threaded hole is formed in the center of the upper end of the clamping structure; the hinged ladder rotating shaft is inserted into the threaded hole of the clamping structure; the locking thread sleeve penetrates through the hinged ladder rotating shaft and then is in threaded connection with the threaded hole of the clamping structure; the sleeve nut is in threaded connection with the locking thread sleeve; a hinge plane is arranged at the upper end of the hinged ladder rotating shaft; a hinge connecting lug is arranged at the lower end of the mop rod; and the hinge plane of the hinged ladder rotating shaft is inserted with the hinge connecting lug at the lower end of the mop rod through a pin shaft to constitute a hinge mechanism of the mop rod.

The clamping structure comprises a main clamping structure and two auxiliary clamping structures; a cavity is arranged at the upper part of the main clamping structure axially; the two auxiliary clamping structures are inserted at both sides of the main clamping structure respectively and connected with the cavity of the main clamping structure in a sliding manner; and after being inserted, the main clamping structure and the auxiliary clamping structures are fixed through an elastic lock catch or a pin bolt or a screw.

A through hole is formed in the middle part of a clamping body of the clamping structure; a fastening bolt is arranged in the middle part of a clamping plate of the clamping structure; the mop panel is in an upper-narrow and lower-wide structure; the through hole is formed in the center of the mop panel; after the fastening bolt penetrates through the through hole of the mop panel and the clamping body, the fastening bolt is fastened through a nut; positioning bosses are arranged at both sides of the middle part of the clamping plate symmetrically; grooves corresponding to the positioning bosses of the clamping plate are arranged at both sides of the clamping body; and tenon interfaces meshed with the positioning bosses of the clamping plate are arranged at both sides of an upper-narrow and lower-wide joint part of the mop panel.

The clamping body of the clamping structure constitutes an integrated water supply type clamping structure mainly by an upper clamping body and a lower clamping body; a water storage cavity is arranged in the upper clamping body; a water filling nozzle with a cover is formed on the upper part of the upper clamping body; a threaded plunger mouth is also formed on the upper clamping body; an adjusting screw rod is connected with the threaded plunger mouth in a rotating manner; a tapered plunger is arranged at the lower end of the adjusting screw rod; a tapered diversion mouth is formed at the relevant position of the threaded plunger mouth corresponding to the bottom of the upper clamping body; the tapered plunger is meshed with a contact surface of the tapered diversion mouth; a standpipe is arranged in the center of the lower clamping body; an internal thread which is in threaded connection with the locking thread sleeve is arranged at the top of the standpipe; a water collecting sump is arranged at the upper part of the lower clamping body; and a plurality of parallel diversion hole channels are arranged in the water collecting sump axially and communicated with the mop panel.

The middle part of the front end of the mop panel is provided with a flat spade which forms a whole with the mop panel; the front end of the flat spade is provided with sawteeth or a flat blade or a combined body of both; the center of the flat spade is provided with a V-shaped groove; and an opening capable of exposing the flat spade is formed in a place where the middle part of the baggy mop sheath corresponds to the flat spade at the front end of the mop plane.

A mop bucket, comprising a bucket body, a squeezing roller pair, U-shaped pedals connected to both ends of the squeezing roller pair and a brush body and characterized in that: an integrated squeezing and brushing device is formed by the connection of the squeezing roller pair and the brush body by virtue of a combined support; the combined support mechanism comprises a left and a right side baffles; the length of the brush body is the same as the axial length of the squeezing roller pair; the brush body is fixedly connected with the left and the right side baffles and the squeezing roller pair through connecting screw rods to form a whole; and the combined support is connected with both walls of the bucket body.

The integrated squeezing and brushing device is pin-connected with both walls of the bucket body, and the integrated squeezing and brushing device overturns upwards at 90 degrees.

An inverted U-shaped groove of which the shape is matched with that of the outer edge of the upper part of the bucket body is arranged outside the upper part of the left and the right side baffles of the integrated squeezing and brushing device; the left and the right side baffles are inserted into the upper part of the bucket body; the inside walls of the left and the right side baffles are respectively provided with a pin library; and both ends of the brush body are provided with rhombic bosses pin-connected with the pin libraries.

The brush body is connected with an electric driving device; the brush body is of a rolling brush structure; the electric driving device comprises a motor and a transmission mechanism; the motor is connected with the rolling brush through the transmission mechanism; and an integrated electric squeezing and brushing device is formed by the motor and the squeezing roller pair.

The electric driving device is powered by a DC power supply; the motor is connected with a battery pack by a microswitch; and the battery pack is connected with a charger.

A standby anti-blackout clear water bucket is arranged on the bucket body where the integrated electric squeezing and brushing device is installed; the standby anti-blackout clear water bucket comprises a water storage tank and a scrubbing brush; the shape of the upper part of the water storage tank is matched with the integrated shape of the bucket body; and the scrubbing brush is installed on the water storage tank along an upper opening thereof.

The present invention has the beneficial effects: Compared with the prior art, the present invention achieves the function of easily turning in the work of wiping hidden corners through the synergistic effect of the hinge mechanism of the mop rod and the steering mechanism; meanwhile, it is more convenient and quicker in the replacement process of wiping relatively narrower and wider working surfaces; a water supply type clamping structure can ensure continuous working process without the need of adding water midway during work; a flat spade is arranged for easily removing such dirt as hard lumps, vegetable leaves and the like stuck to the ceramic tiles; the mop bucket used with the mop can meet the requirement that the squeezing rollers and the brush body keep respective functions in the mop bucket without occupying more space; and the integrated squeezing and brushing device formed by the connection of the mop bucket and the brush body by virtue of a combined support can further reduce the volume of the mop bucket and provide an affordable and practical product to the user. The integrated electric squeezing and brushing device and the standby anti-blackout clear water bucket are adopted for saving energy and improving the quality of the product. The present invention can be widely applied to the cleaning of ground, wall surfaces, roofs and glass in families or public places.

In the Figure: 1. Mop rod, 2. Mop panel, 2-1. Flat spade, 2-2. V-shaped groove, 3. Clamping body, 3-1. Upper clamping body, 3-2. Lower clamping body, 3-2-1. Standpipe, 3-2-2. Water collecting sump, 3-2-3. Diversion hole channel, 3-3. Water storage cavity, 3-4. Water filling nozzle, 3-5. Threaded plunger mouth, 3-6. Adjusting screw rod, 3-7. Tapered plunger, 3-8. Tapered diversion mouth, 4. Clamping plate, 5. Steering mechanism, 6. Sleeve nut, 7. Locking thread sleeve, 8. Hinged ladder rotating shaft, 9. Threaded hole, 10. Hinge plane, 11. Hinge connecting lug, 12. Main clamping structure, 13. Auxiliary clamping structure, 14. Cavity, 15. Elastic lock catch, 16. Through hole, 17. Through hole. 18. Fastening bolt, 19. Positioning boss, 19-1. Groove, 19-2. Tenon interface, 20. Mop bucket, 21. Bucket body, 22. Squeezing roller pair, 23. U-shaped pedal, 24. Brush body, 24-1. Rhombic boss, 25. Combined support, 25-1. Left and right side baffles, 25-2. Connecting screw rod, 25-3. U-shaped groove, 25-4. Pin library, 25-5. Locking boss, 26. Motor, 27. Transmission mechanism, 28. Clear water bucket, 28-1. Water storage tank, 28-2. Auxiliary scrubbing brush, 29. Hinge mechanism.

DETAILED DESCRIPTION OF EMBODIMENTS

The embodiments of the present invention will be described in detail in combination with better embodiments.

Embodiments

Figure 1:
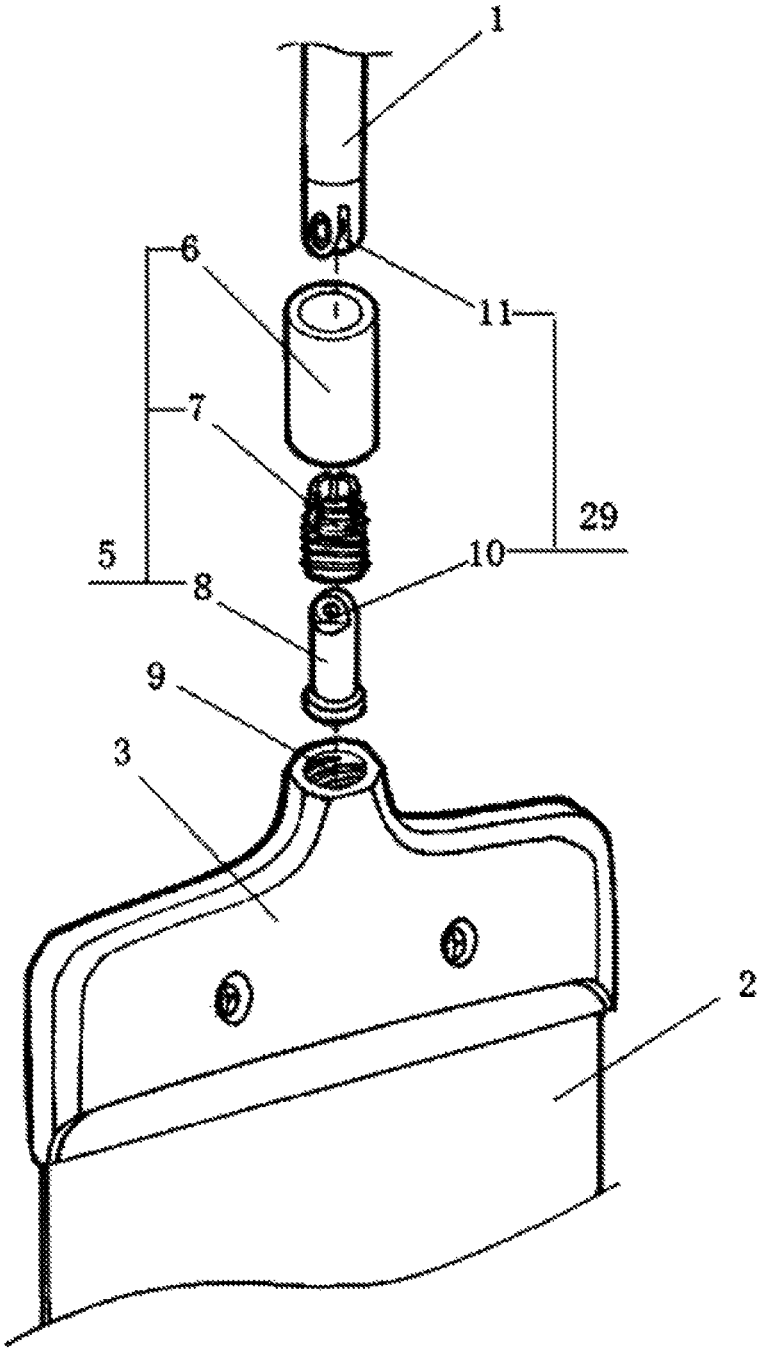
FIG. 1 is a structural diagram of a portable mop (excluding a baggy mop sheath)

Please see FIG. 1 for details. A portable mop comprises a mop rod 1, a mop panel 2 and a baggy mop sheath (not shown in the Figure). The upper end of an elastic flaky mop panel is connected with the mop rod through a clamping structure; the clamping structure is composed of a clamping body 3 and a clamping plate 4; a steering mechanism 5 is arranged on the mop rod and comprises a sleeve nut 6, a locking thread sleeve 7 and a hinged ladder rotating shaft 8, wherein the locking thread sleeve is provided with an external thread, the upper end of the locking thread sleeve is in a shape of a circular cone and is provided with three openings which are in an elastic shape, the center of the locking thread sleeve is provided with a round hole, and the round hole of the locking thread sleeve is in sliding fit with the hinged ladder rotating shaft; a threaded hole 9 is formed in the center of the upper end of the clamping structure; the hinged ladder rotating shaft is inserted into the threaded hole of the clamping structure; the locking thread sleeve penetrates through the hinged ladder rotating shaft and then is in threaded connection with the threaded hole of the clamping structure; the sleeve nut is in threaded connection with the locking thread sleeve; a hinge plane 10 is arranged at the upper end of the hinged ladder rotating shaft; a hinge connecting lug 11 is arranged at the lower end of the mop rod; and the hinge plane of the hinged ladder rotating shaft is inserted with the hinge connecting lug at the lower end of the mop rod through a pin shaft (not shown in the Figure) to constitute a hinge mechanism 29 of the mop rod. Generally, a steering device of the common panel mop is realized mostly by a hinge or a universal shaft technology. Because the portable mop rod and a center line of the mop panel are in a straight line or parallel, in normal operation, an angle of the mop rod and a working surface is between 30 degrees to 50 degrees and the front end of the mop panel is parallel to the working surface. The mop panel cannot be parallel to the working surface when steering only with a hinge way. The difficult point is that the mop rod can work only when closing to the working surface, but an operator cannot work under this condition. The ideal situation is that: after steering through the hinge, operation is carried out at any point in a space by taking the hinge as an axle center at the lower end of the mop rod, and the front end of the mop panel and the working surface are in a parallel state. According to the present invention, the sleeve nut is tightened through a synergistic effect of the hinge mechanism and the steering mechanism of the mop rod; the mop panel and the clamping structure cannot rotate; the mop panel and the clamping structure are in a same axis with the mop rod; and the mop enters a normal working state; when work shall be made at the turnings or narrow places, the locking thread sleeve is unscrewed and moved upward along the mop rod to expose the hinge; an angle of 30 degrees to 50 degrees is formed by the mop rod and the working surface through the hinge mechanism on the mop panel and the clamping structure; and at this time, the hinged ladder rotating shaft can forwardly and reversely rotate for 360 degrees in the locking thread sleeve. At this time, no matter which position the mop rod is located in the space, the mop panel and the working surface can be ensured to be parallel, thereby achieving the purpose of wiping the hidden corners by turning.

Figure 2:
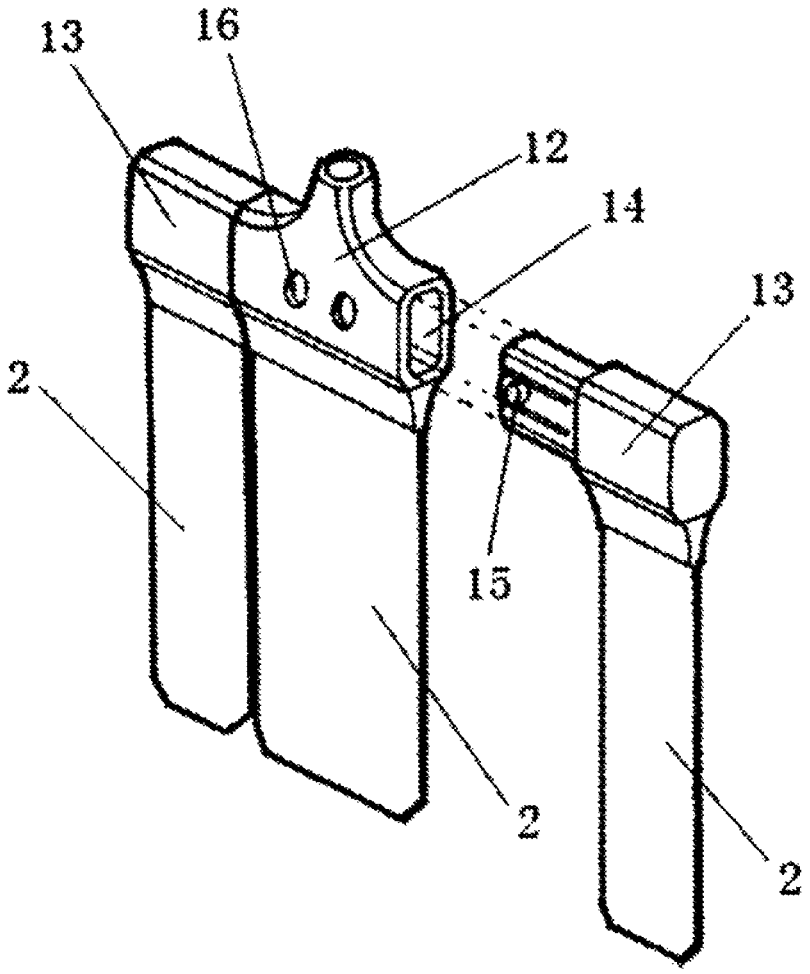
FIG. 2 is a structural diagram of a clamping structure with a main and an auxiliary clamping structures.

Please see FIG. 2 for details. The preferred solution of the present invention is that: the clamping structure comprises a main clamping structure 12 and two auxiliary clamping structures 13; a cavity 14 is arranged at the upper part of the main clamping structure axially; the two auxiliary clamping structures are inserted at both sides of the main clamping structure respectively and connected with the cavity of the main clamping structure in a sliding manner; the shapes of the two auxiliary clamping structures are the extension of the shape of the main clamping structure; the width of the two auxiliary clamping structures is less than that of the main clamping structure; the middle part of the main clamping structure is in a hollow structure; and a through hole 16 is at least arranged in the position that the front and the rear surfaces of the hollow structure are away from an edge and close to the center line. After being inserted, the main clamping structure and the auxiliary clamping structures are fixed through an elastic lock catch 15 and the through hole 16 or a pin bolt or a screw. The width of the main clamping structure is generally designed at 8 cm to 10 cm, thereby being convenient for wiping a narrow area; and the width of the auxiliary clamping structures is generally designed at about 5 cm to 6 cm, and the overall width reaches about 20 cm through embedding, thereby meeting the need of common families. With the adoption of the structure, the operation can be carried out by dismantling the two auxiliary clamping structures when needing to wipe the narrow working surface. If the outside of the clamping structure is designed as an open structure, the insertion can also continue by adjusting the width of a single body, so as to meet the need of a bigger occasion; and there is no need to make a larger mop bucket, and the single body is only dismantled, cleaned and squeezed to be dry in hand.

Figure 3:
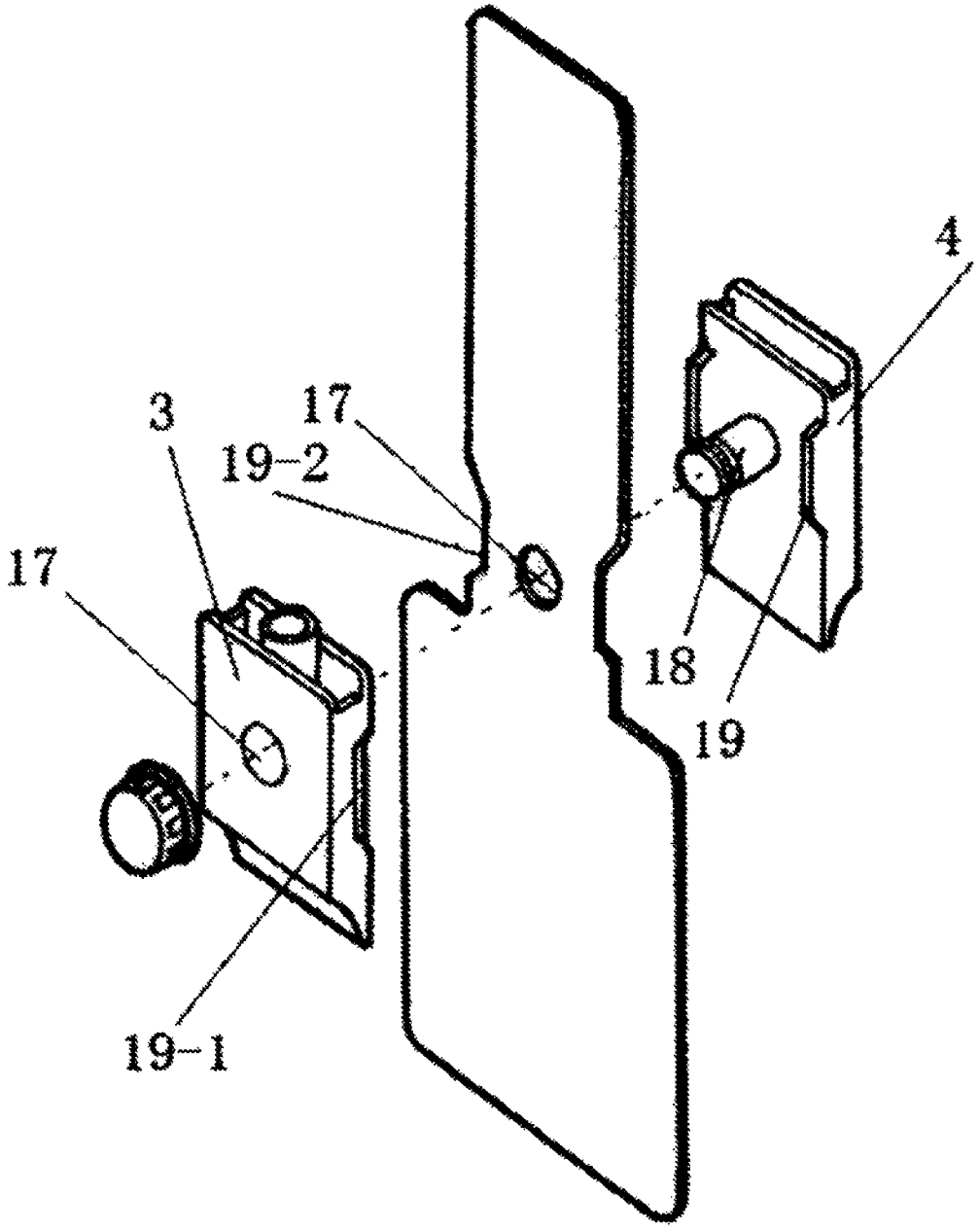
FIG. 3 is a structural diagram for a upper-narrow and lower-wide mop panel.

Please see FIG. 3 for details. The preferred solution of the present invention is that: a through hole 17 is formed in the middle part of a clamping body 3 of the clamping structure; a fastening bolt 18 is arranged in the middle part of a clamping plate 4 of the clamping structure; the mop panel is in an upper-narrow and lower-wide structure; the through hole 17 is formed in the center of the mop panel; after the fastening bolt penetrates through the through hole of the mop panel and the clamping body, the fastening bolt is fastened through a nut; positioning bosses 19 are arranged at both sides of the middle part of the clamping plate symmetrically; grooves 19-1 corresponding to the positioning bosses of the clamping plate are arranged at both sides of the clamping body; and tenon interfaces 19-2 meshed with the positioning bosses of the clamping plate are arranged at both sides of an upper-narrow and lower-wide joint part of the mop panel. At present, the width of the mop panel in the clamping structure of the portable mop is fixed. According to the present invention, the mop panel is made in such a manner that one surface is wide and the other surface is narrow, thereby adapting to the operation of the working surfaces with different widths. The fastening bolt can penetrate through the through holes of the mop panel and a base plate by virtue of the size of the fastening bolt and the external thread of the fastening bolt is exposed outside the through hole of the base plate; the positioning bosses are arranged at both sides of the middle part of the clamping plate symmetrically and correspond to indentations at both sides of the base plate and openings at both sides of the mop panel; one surface of the locking nut can be selected to be operated; the nut is unscrewed; after the plane of the mop panel is adjusted for 180 degrees, the nut is locked again, thereby realizing the position transformation of wide and narrow surfaces.

Figure 4:
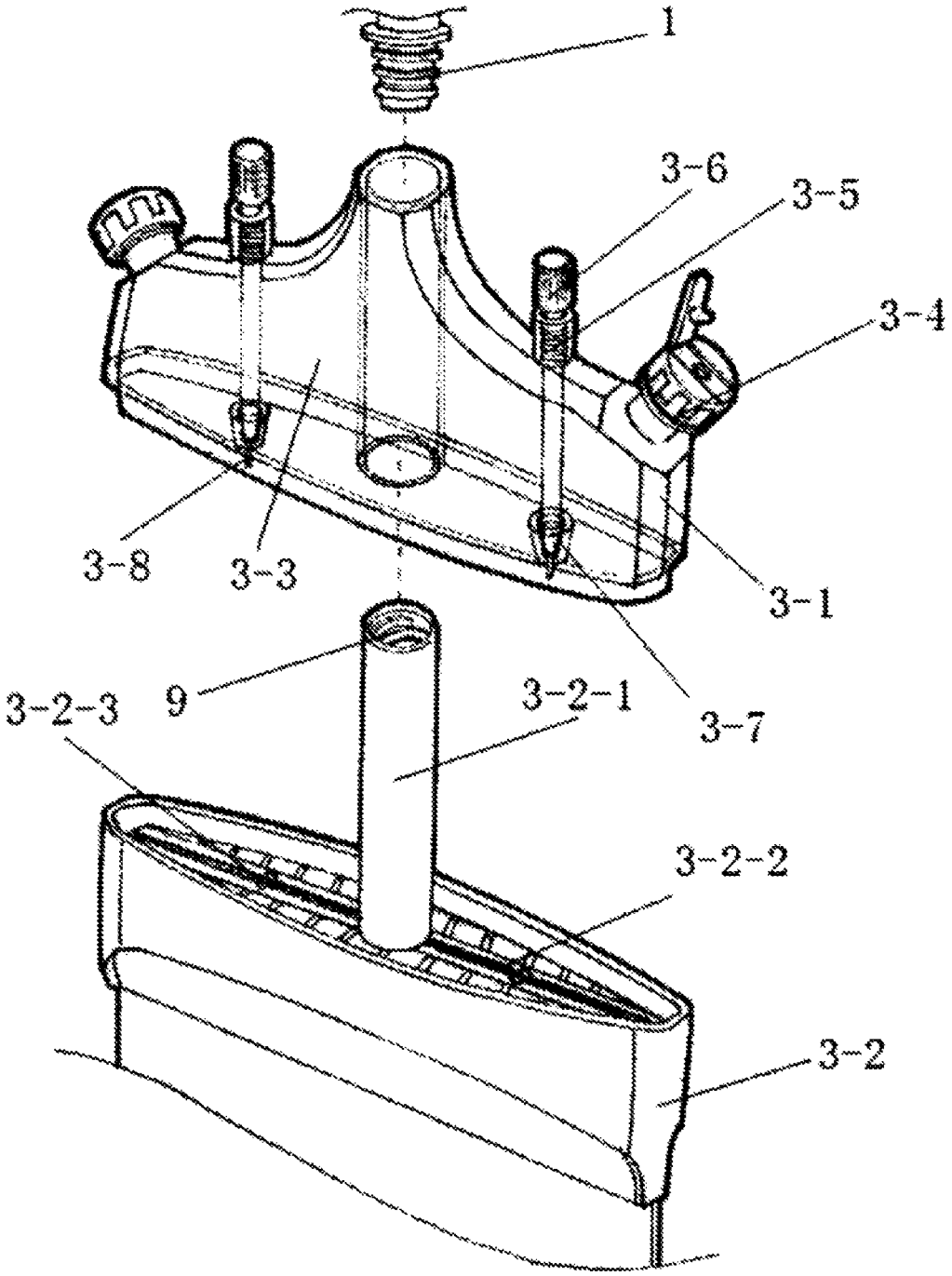
FIG. 4 is a structural diagram of a water supply type clamping structure.

Please see FIG. 4 for details. The preferred solution of the present invention is that: the clamping body 3 of the clamping structure constitutes an integrated water supply type clamping structure mainly by an upper clamping body 3-1 and a lower clamping body 3-2; a water storage cavity 3-3 is arranged in the upper clamping body; a water filling nozzle 3-4 with a cover is formed on the upper part of the upper clamping body; a threaded plunger mouth 3-5 is also formed on the upper clamping body; an adjusting screw rod 3-6 is connected with the threaded plunger mouth in a rotating manner; a tapered plunger 3-7 is arranged at the lower end of the adjusting screw rod; a tapered diversion mouth 3-8 is formed at the relevant position of the threaded plunger mouth corresponding to the bottom of the upper clamping body; the tapered plunger is meshed with a contact surface of the tapered diversion mouth; a standpipe 3-2-1 is arranged in the center of the lower clamping body; an internal thread which is in threaded connection with the locking thread sleeve is arranged at the top of the standpipe; a water collecting sump 3-2-2 is arranged at the upper part of the lower clamping body; and a plurality of parallel diversion hole channels 3-2-3 are arranged in the water collecting sump axially and communicated with the mop panel.

Generally, the method of adding a water supply device on a home panel mop mostly refers to adding a water storage bottle at the lower end of the mop rod, installing a trigger on a handle, and installing a nozzle at the front end of the mop for pressurizing and spraying water through a pipe. For the device, the mop is not portable, the handle is not flexible, and the open water sprayed on floor is undoubtedly harmful for a spliced composite floor which exposes an obvious joint deliberately. The ideal water supply way is that the controllable water is directly dripped on the mop cloth. According to the present invention, a water storage container is arranged in the clamping structure; at least one water filling nozzle is formed at both sides of the upper end of the container and arranged symmetrically at best for the purpose of beauty; a bottle cap on the water filling nozzle is in threaded connection with the water filling nozzle; and a round air inlet and a hole plug are arranged at the top of the cover. Two plunger mouths with the internal threads are formed in the middle part of the upper end of the container symmetrically; a tapered drainage hole is formed at the bottom of the container corresponding to the two plunger mouths; the tapered bottom is a plane; and the shape of a plunger of which the upper end is provided with a wrench and the external thread and the lower end is provided with a diversion column is meshed with the inner wall of a tapered water outlet. A tubular through hole is formed in the center of the container; the standpipe is arranged in the center of the lower part of the clamping structure; the internal thread is provided at the top of the standpipe; a plurality of diversion hole channels are arranged between the mop panel and the clamping plate at both sides of the standpipe symmetrically; the standpipe penetrates through the central pipe of the container and is in threaded connection with the lower end of the mop rod; and because a round cushion integrated with the external thread is arranged at the top of the external thread at the lower end of the mop rod, a retreat table is arranged at the bottom of the container and the container is further integrated with the clamping structure, without the need for occupying other spaces of the mop and without affecting the operation of the user regardless of cleaning, squeezing and operating. As the increase of liquid is limited, the heavy feeling is not produced. The leakproofness is good; the water is not dripped by using inversely even if wiping high places; it is important that the air inlet effectively controls the air pressure in the container, and the liquid flow rate can be increased and the liquid dripping effect can also be reached by virtue of screw propulsion of the plunger. Moreover, during operation, an inclination angle formed naturally makes the water flow towards the clean fabrics on the working surface due to a principle of gravity, regardless of using any of two surfaces; and the container is made of transparent materials, and the stock of the liquid can be directly observed and the aesthetic feeling of the container can also be added.

Figure 5:
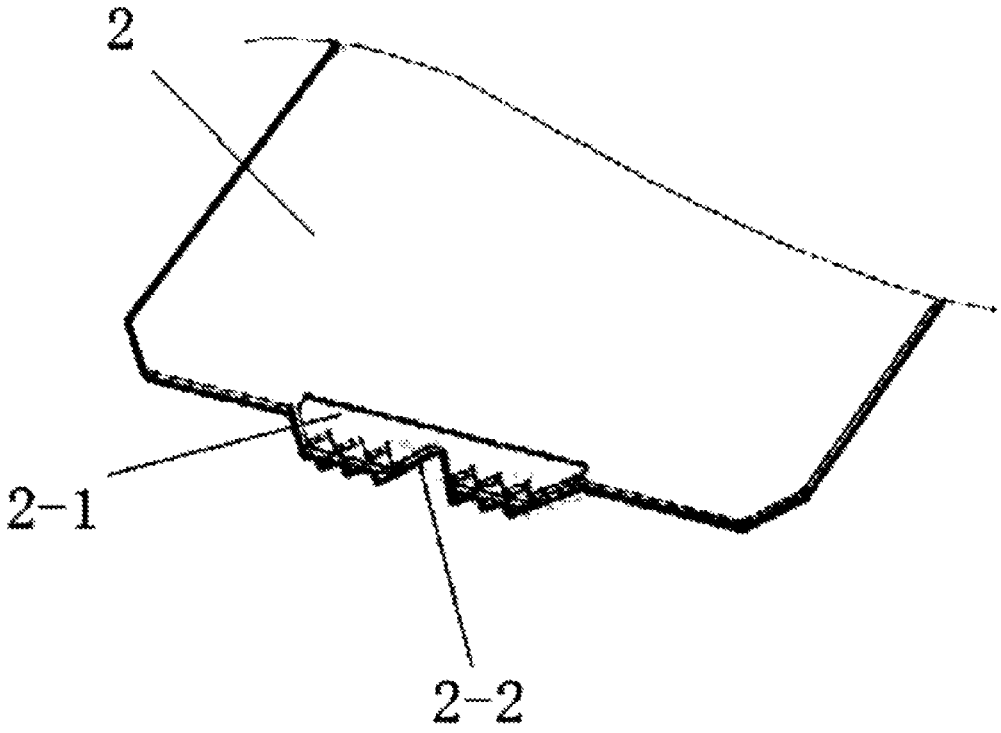
FIG. 5 is a structural diagram of a flat spade at the front end of a mop panel.

Please see FIG. 5 for details. The preferred solution of the present invention is that: the middle part of the front end of the mop panel 2 is provided with a flat spade 2-1 which forms a whole with the mop panel 2. The front end of the flat spade is provided with sawteeth or a flat blade or a combined body of both; the center of the flat spade is provided with a V-shaped groove 2-2; and an opening (not shown in the Figure) capable of exposing the flat spade is formed in a place where the middle part of the baggy mop sheath corresponds to the flat spade at the front end of the mop plane. In general, during household wiping, ceramic tiles are easiest to wipe due to its high rigidity and finish, but are the most difficult to wipe. Hard lumps, vegetable leaves and soup stuck to the ceramic tiles in kitchen room cannot be wiped off under wet conditions, and must be wiped off by virtue of tools such as the flat spade. In case that the mop cloth is covered, wiping and shoveling cannot be simultaneously finished during wiping. The bottom center of the mop cloth is not cut off due to the V-shaped groove, so the effect of wiping while shoveling can be truly realized. Even if frequent collision happens during operation, tooth tips can be effectively protected from being damaged easily.

Figure 6:
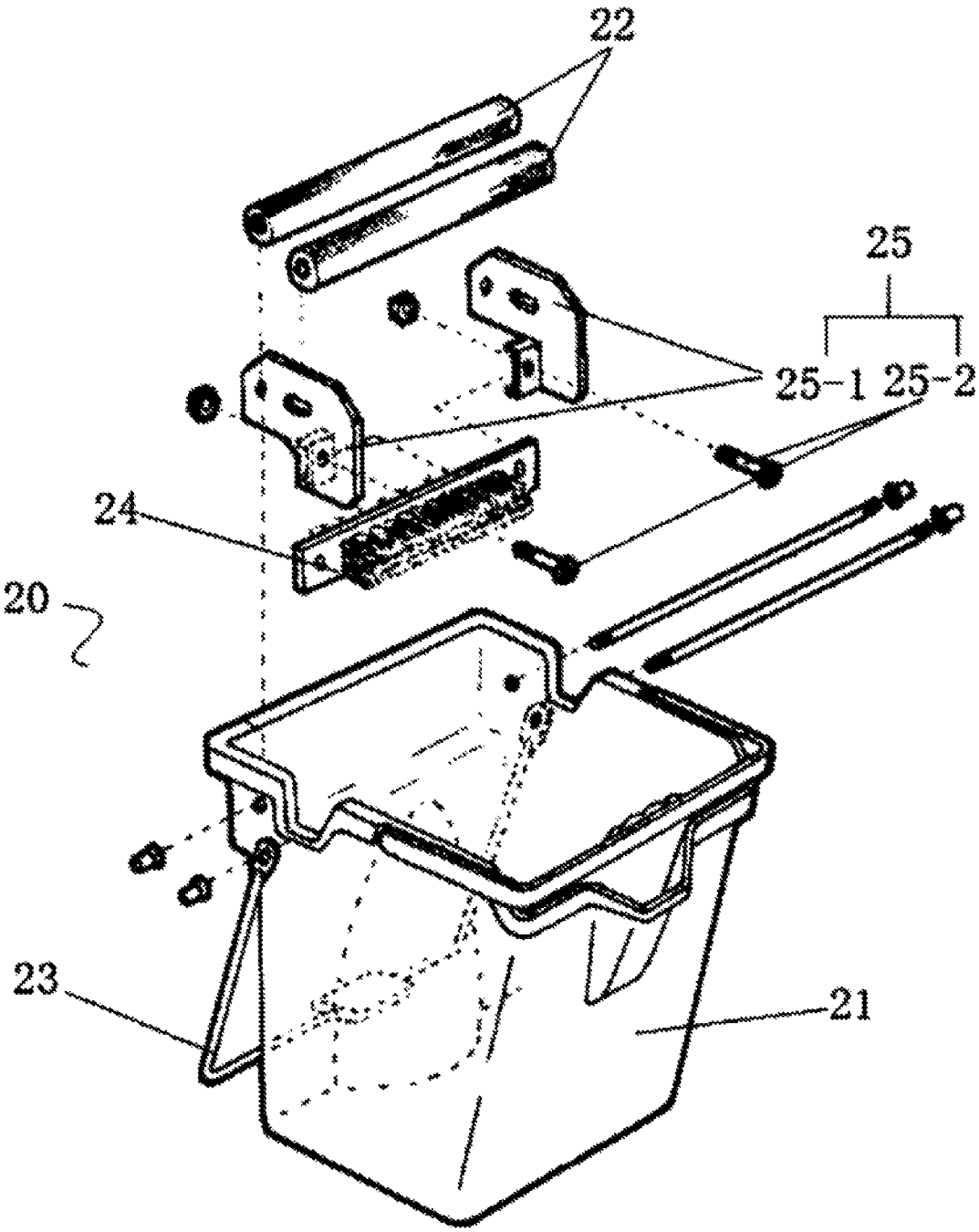
FIG. 6 is a structural diagram of an integrated squeezing and brushing device of a mop bucket.

Please see FIG. 6 for details. A mop bucket 20 comprises a bucket body 21, an squeezing roller pair 22, U-shaped pedals 23 connected to both ends of the squeezing roller pair and a brush body 24, wherein an integrated squeezing and brushing device is formed by the connection of the squeezing roller pair and the brush body by virtue of a combined support 25; the combined support mechanism comprises a left and a right side baffles 25-1, and the length of the brush body is the same as the axial length of the squeezing roller pair. The brush body, the left and the right side baffles and the squeezing roller pair are fixedly connected through connecting screw rods 25-2 to form a whole, and the combined support is connected with both walls of the bucket body. The problems of cleaning and squeezing in the flat mop can be solved without dismantling the mop cloth or using hands by the combination of the mop plane made of an elastic material, rollers and the brush body. The integrated squeezing and brushing device is used for reducing the space of the mop bucket. The two upper side walls at the rear part of the bucket body are symmetrically provided with round through holes in which fixed squeezing rollers are mounted; both ends of the squeezing rollers are connected with U-shaped pedals as well as the left and the right side baffles at right angles; and the lower end of the squeezing rollers far away from the center line of the space between the two through holes is provided with the brush body. When a brush surface faces forwards, the integrated squeezing and brushing device is pin-connected with both walls of the bucket body, and the integrated squeezing and brushing device overturns upwards at 90 degrees. The integrated squeezing and brushing device can further expand used space within the bucket and reduce the volume of the mop bucket, so as to provide an affordable and practical product to the user. There are many modes of support. For example, an independent support and the two side baffles are fixedly connected or formed once by an L-shaped transverse support capable of placing and fixing the brush body; both ends of the transverse support are of U shapes to clamp the brush body; and a key hole is formed in the bottom surface of the middle part of the transverse support. Correspondingly, one side of the middle part of the brush body is provided with a cylindrical boss; the length of the brush body is less than the width of the inner surface of the transverse support; and the brush body is placed along the key hole and moves towards one end of the transverse support. Or, the squeezing roller shaft and the side baffles are fixedly connected to form the combined support through a plurality of nuts; or, both ends of the brush body and the side baffles are fixedly connected or formed once to form the combined support. The distance between a fixed squeezing roller and a movable squeezing roller is so narrow that only the mop panel sleeved with the mop sheath is allowed to pass through. The distance between the squeezing roller pair and the bottom part of the mop bucket is greater than the length of the mop panel.

Figure 10:
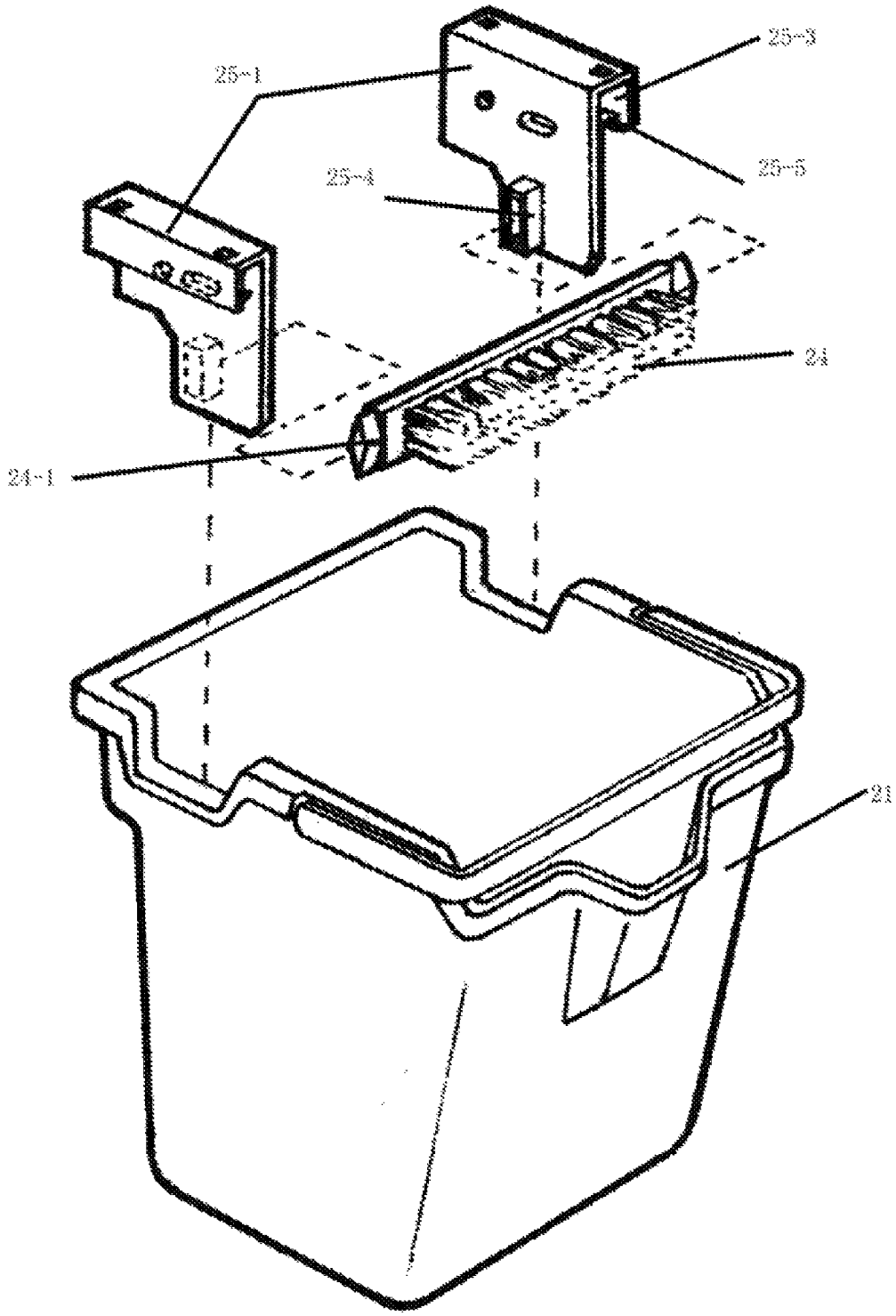
FIG. 10 is a structural diagram of an integrated plug-in type squeezing and brushing device.

Please see FIG. 10 for details. The preferred solution of the present invention is that: an inverted U-shaped groove 25-3 of which the shape is matched with that of the outer edge of the upper part of the bucket body is arranged outside the upper part of the left and the right side baffles of the integrated squeezing and brushing device. The left and the right side baffles are inserted into the upper part of the bucket body; the inside walls of the left and the right side baffles are respectively provided with a pin library 25-4; and both ends of the brush body are provided with rhombic bosses 24-1 pin-connected with the pin libraries. In order to conveniently dismount and mount the integrated squeezing and brushing device when the mop bucket is washed, a moving space for the movable squeezing rollers between both side walls of the bucket body is expanded to the outer edge of an axial hole of the fixed squeezing roller, so as to allow the left and the right baffles on both sides to clamp the outer edges of the upper parts at both sides of the bucket body removably. The specific practice of the embodiment is that: the inverted U-shaped groove is arranged outside the upper part of the left and the right baffles 25-1; the shape of the upper part of the inverted U-shaped groove is matched with that of the outer edge of the upper part of the bucket body; and right-angled locking bosses 25-5 are arranged inside the lower parts of outer edges at both ends of the inverted U-shaped groove. While being dismounted, the mop bucket can be dismounted by drawing out the bosses outwards and then lifting up the squeezing rollers upwards. The mop bucket can be installed only by integrally placing the overall squeezing and brushing device into the locking bosses in the bucket body to return to the primary position. As for this solution, there is no need to dismount and mount the squeezing rollers and the brush body one by one. In particular, the complexity and the time for aiming at the hole in the inner wall of the bucket body to penetrate through the shaft can be saved to increase working efficiency. The end surfaces of both ends of the brush body are rhombic bosses; the lower parts of the side baffles corresponding to the rhombic bosses are provided with pin libraries that are suitable for the shape of the rhombic bosses; the thicknesses of the rhombic bosses are greater than the inner depths of the pin libraries; and the rhombic bosses are movably and detachably connected with the pin libraries. Both ends of the brush body that are designed to be of rhombic shapes are movably connected with the side baffles, the role of which is to wash the mop sheath more thoroughly in such a manner that the brush surface and the mop sheath surface will automatically align their positions along with the moving direction of the mop rod during the process of washing the mop sheath from top to bottom. Specifically, there is a significant effect when a two-brush structure is adopted and installed. Firstly, the position of the side baffle where a single brush is installed extends for the length of one brush body forwards; similarly, two brush bodies are opposite to each other by means of a previous connection mode. Because the centers of gravity of the brush bodies are at the top ends of bristles, the brush bodies will droop naturally due to the rhombic ends. When the upper ends of the bristles of the two brush bodies touch the shoulders, the lower parts of the brush bodies present a triangular space, and at this time, dirt will not rebound by the bristles when the smudgy mop sheath is inserted into the space. When the mop sheath is upwards lifted, the bristles will firmly catch the surface of the mop sheath due to the movement of the brush bodies, and dirt will be brought into water in the bucket body. At this time, an inverted triangular space is formed by the brush bodies; it is easier to lift up the front end of the mop sheath; and the two surfaces of the mop sheath may be cleaned up only once, thereby saving time, saving labor and shortening working hours. It should be noted that adopting two corresponding rhombic parallel edges or designing cross projections at both ends of the brush body may have the same effect.

Figure 7:
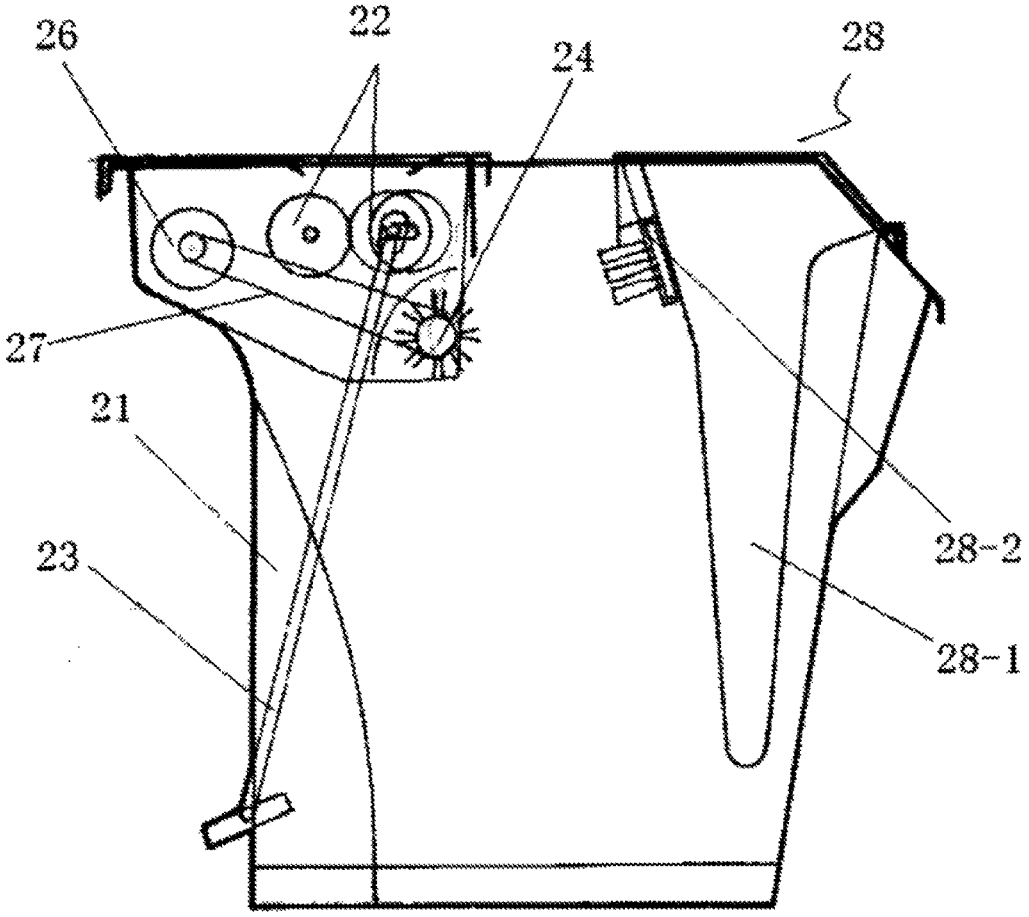
FIG. 7 is a structural diagram of a mop bucket with an integrated electric squeezing and brushing device.
Figure 8:
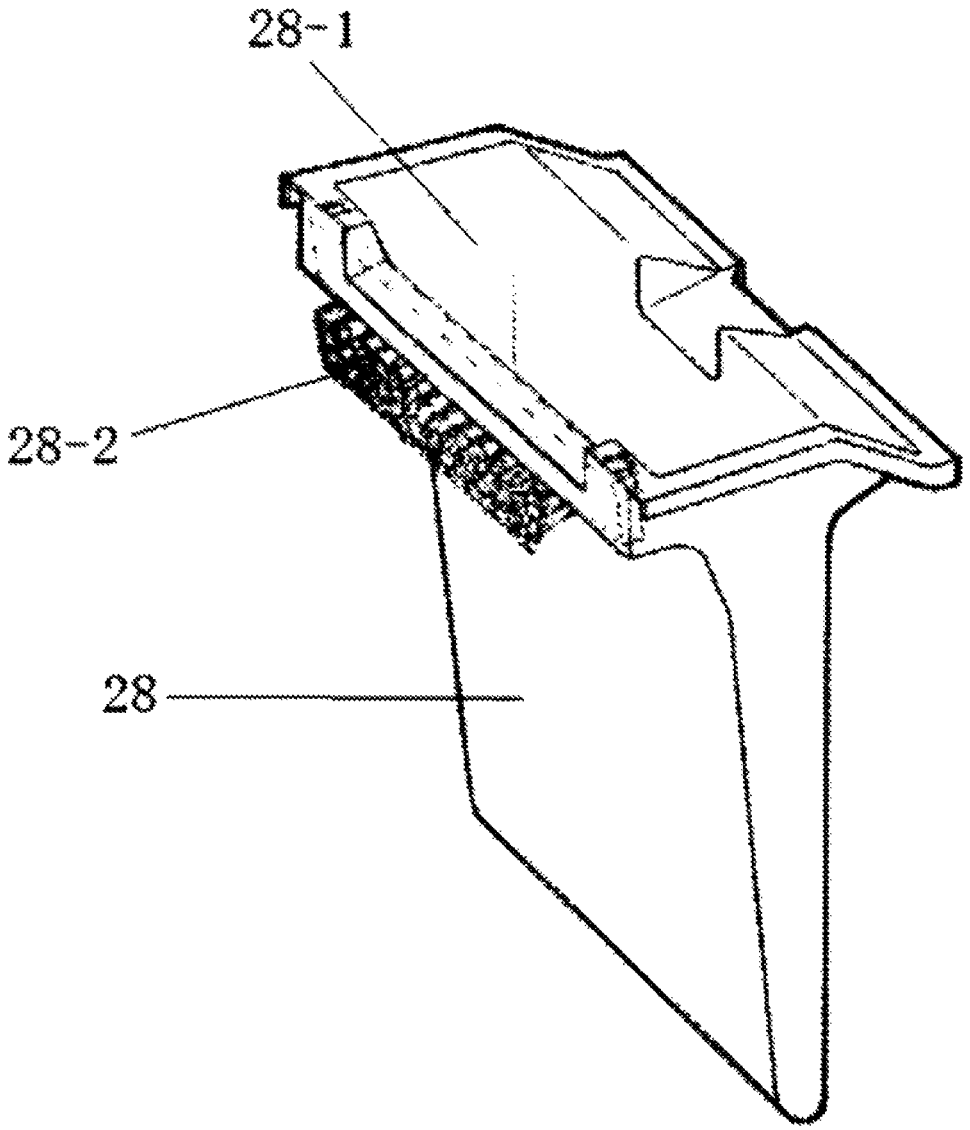
FIG. 8 is a structural diagram of a standby anti-blackout clear water bucket.
Figure 9:
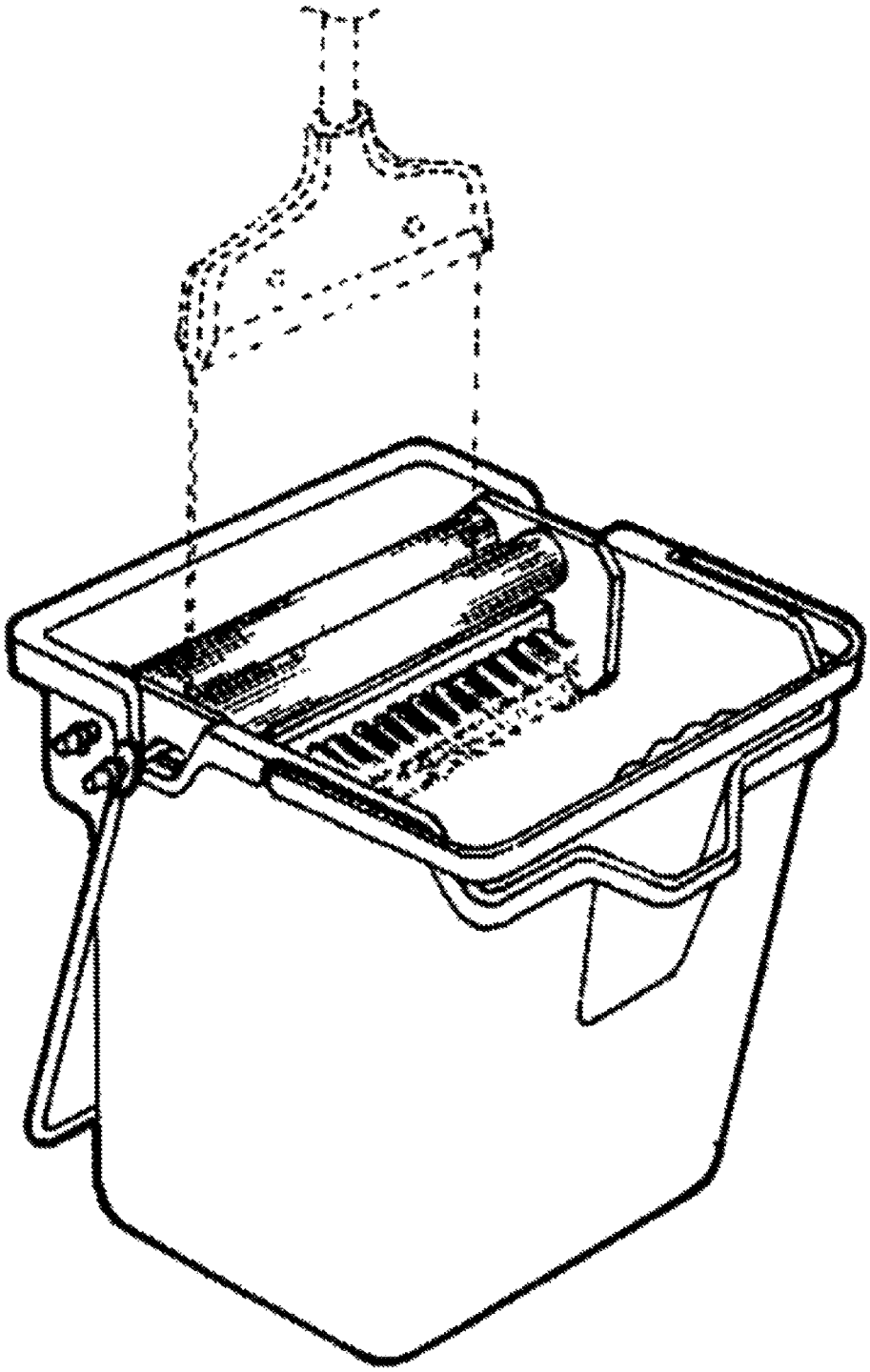
FIG. 9 is a reference diagram for a usage state of a mop bucket and a mop.

Please see FIGS. 7-9 for details. The preferred solution of the present invention is that: the brush body is connected with an electric driving device; and the brush body is of a rolling brush structure. The electric driving device comprises a motor 26 and a transmission mechanism 27. The motor is connected with the rolling brush through the transmission mechanism, and an integrated electric squeezing and brushing device is formed by the motor and the squeezing roller pair. The electric driving device is powered by a DC power supply; the motor is connected with a battery pack by a microswitch; and the battery pack is connected with a charger (not shown in the figure). A standby anti-blackout clear water bucket 28 is arranged on the bucket body where the integrated electric squeezing and brushing device is installed. The standby anti-blackout clear water bucket 28 comprises a water storage tank 28-1 and an auxiliary scrubbing brush 28-2. The shape of the upper part of the water storage tank is matched with the integrated shape of the bucket body, and the auxiliary scrubbing brush is installed on the water storage tank along an upper opening thereof. For the reason that after the mop cloth is washed and squeezed for several times, the mop bucket is filled with sewage and the mop cloth cannot wipe up the floor in continuous work after squeezing, the water storage tank is installed to clear away sewage ingredients within the mop cloth to achieve the purpose of cleaning in such a way of getting wet with water after the sewage is squeezed twice. The driving device of an electric rolling brush, a transmission unit and the squeezing rollers are combined in one frame and can be dismounted. To leave an enough placing space for the water storage tank that is detachably arranged at the front end in the bucket, an integrated frame may be arranged at the rear end of the upper part of the mop bucket. In case that the battery is powered off suddenly, the auxiliary scrubbing brush may continue wiping instead of the rolling brush. A microstroke switch may be placed on an outer baffle at the upper end of the electric rolling brush. When the mop cloth sleeved on the mop panel moves from the bottom up to touch the switch, the motor may drive the rolling brush to operate but may stop when the mop cloth leaves, with the purpose of saving power and convenience. Waterproof sealing shall be done. In order to prevent electric leakage, the switch may be arranged on the bucket wall above the front end of the U-shaped pedals to minimize the leakage rate. One 4.8 v charging storage battery may be charged continuously for 10 h to allow a driving motor to drive the rolling brush to continuously operate for 40 min. Therefore, only one kilowatt hour of power is consumed every month. When the electric rolling brush is used for brushing the double-faced mop cloth sleeved on the mop panel in the mop bucket, 5 or 6 seconds are needed only, and about only half a minute is consumed for brushing a room of 100 $m^2$. The electric rolling brush, after being charged once, may be used for more than one month, and therefore the maximum efficiency can be realized with minimum energy, thereby saving energy, shortening working hours and increasing working efficiency.

The above embodiments are only the preferred embodiments of the present invention, and have no limitations to the structure of the present invention in any form. Any simple amendment, equivalent change and modification made to the above embodiments according to the technical essence of the present invention all belong to the scope of the technical solution of the present invention.

We claim:

1. A portable mop, comprising a mop rod, a mop panel and a baggy mop sheath; the upper end of the mop panel is connected with the mop rod through a clamping structure; the clamping structure is composed of a damping body and a clamping plate and characterized in that: a steering mechanism is arranged on the mop rod and comprises a sleeve nut, a locking thread sleeve and a hinged ladder rotating shaft;

wherein the locking thread sleeve is provided with an external thread; the upper end of the locking thread sleeve is in a shape of a circular cone; the center of the locking thread sleeve is provided with a round hole; a threaded hole is formed in the center of the upper end of the clamping structure; the hinged ladder rotating shaft is inserted into the threaded hole of the clamping structure; the locking thread sleeve penetrates through the hinged ladder rotating shaft and then is in threaded connection with the threaded hole of the clamping structure; the sleeve nut is in threaded connection with the locking thread sleeve; a hinge plane is arranged at the upper end of the hinged ladder rotating shaft; a hinge connecting lug is arranged at the lower end of the mop rod; and the hinge plane of the hinged ladder rotating shaft is inserted with the hinge connecting lug at the lower end of the mop rod to constitute a hinge mechanism of the mop rod.

2. The portable mop according to claim 1, characterized in that: the damping structure comprises a main clamping structure and two auxiliary clamping structures; a cavity is arranged at the upper part of the main clamping structure axially; the two auxiliary clamping structures are inserted at both sides of the main clamping structure respectively and connected with the cavity of the main clamping structure in a sliding manner; and after being inserted, the main clamping structure and the auxiliary clamping structures are fixed through an elastic lock catch or a pin bolt or a screw.

3. The portable mop according to claim 1, characterized in that: a through hole is formed in the middle part of a clamping body of the clamping structure; a fastening bolt is arranged in the middle part of a clamping plate of the clamping structure; the mop panel is in an upper-narrow and lower-wide structure; the through hole is formed in the center of the mop panel; after the fastening bolt penetrates through the through hole of the mop panel and the clamping body, the fastening bolt is fastened through a nut: positioning bosses are arranged at both sides of the middle part of the clamping plate symmetrically; grooves corresponding to the positioning bosses of the clamping plate are arranged at both sides of the clamping body; and tenon interfaces meshed with the positioning bosses of the clamping plate are arranged at both sides of an upper-narrow and lower-wide joint part of the mop panel.

4. The portable mop according to claim 1, characterized in that: the clamping body of the clamping structure constitutes an integrated water supply type clamping structure mainly by an upper clamping body and a lower clamping body; a water storage cavity is arranged in the upper clamping body; a water filling nozzle with a cover is formed on the upper part of the upper clamping body; a threaded plunger mouth is also formed on the upper clamping body; an adjusting screw rod is connected with the threaded plunger mouth in a rotating manner; a tapered plunger is arranged at the lower end of the adjusting screw rod; a tapered diversion mouth is formed at the relevant position of the threaded plunger mouth corresponding to the bottom of the upper clamping body; the tapered plunger is meshed with a contact surface of the tapered diversion mouth; a standpipe is arranged in the center of the lower clamping body; an internal thread which is in threaded connection with the locking thread sleeve is arranged at the top of the standpipe; a water collecting sump is arranged at the upper part of the lower clamping body; and a plurality of parallel diversion hole channels are arranged in the water collecting sump axially and communicated with the mop panel.

5. The portable mop according to claim 1, characterized in that: the middle part of the front end of the mop panel is provided with a flat spade which forms a whole with the mop panel; the front end of the flat spade is provided with sawteeth or a flat blade or a combined body of both; the center of the flat spade is provided with a V-shaped groove; and an opening capable of exposing the flat spade is formed in a place where the middle part of the baggy mop sheath corresponds to the flat spade at the front end of the mop plane.

6. A mop bucket used with the portable mop according to claim 1, comprising a bucket body, a squeezing roller pair, U-shaped pedals connected to both ends of the squeezing roller pair and a brush body and characterized in that an integrated squeezing and brushing device is formed by the connection of the squeezing roller pair and the brush body by virtue of a combined support; the combined support mechanism comprises a left and a right side baffles; the length of the brush body is the same as the axial length of the squeezing roller pair; the brush body is fixedly connected with the left and the right side baffles and the squeezing roller pair through connecting screw rods to form a whole; and the combined support is connected with both walls of the bucket body.

7. The mop bucket used with the portable mop according to claim 6, characterized in that: the integrated squeezing and brushing device is pin-connected with both walls of the bucket body, and the integrated squeezing and brushing device overturns upwards at 90 degrees.

8. The mop bucket used with the portable mop according to claim 6, characterized in that: an inverted U-shaped groove of which the shape is matched with that of the outer edge of the upper part of the bucket body is arranged outside the upper part of the left and the right side baffles of the integrated squeezing and brushing device: the left and the right side baffles are inserted into the upper part of the bucket body; the inside walls of the left and the right side baffles are respectively provided with a pin library; and both ends of the brush body are provided with rhombic bosses pin-connected with the pin libraries.

9. The mop bucket used with the portable mop according to claim 6, characterized in that: the brush body is connected with an electric driving device; the brush body is of a rolling brush structure; the electric driving device comprises a motor and a transmission mechanism; the motor is connected with the rolling brush through the transmission mechanism; an integrated electric squeezing and brushing device is formed by the motor and the squeezing roller pair; the electric driving device is powered by a DC power supply; the motor is connected with a battery pack by a microswitch; and the battery pack is connected with a charger.

10. The mop bucket used with the portable mop according to claim 9, characterized in that: a standby anti-blackout clear water bucket is arranged on the bucket body where the integrated electric squeezing and brushing device is installed; the standby anti-blackout clear water bucket comprises a water storage tank and a scrubbing brush; the shape of the upper part of the water storage tank is matched with the integrated shape of the bucket body; and the scrubbing brush is installed on the water storage tank along an upper opening thereof.

* * * * *